US006374838B1

(12) United States Patent
Baugh

(10) Patent No.: US 6,374,838 B1
(45) Date of Patent: Apr. 23, 2002

(54) COLLAPSIBLE PIG

(76) Inventor: Benton F. Baugh, 14626 Oak Bend, Houston, TX (US) 77079-6441

( * ) Notice: Subject to any disclaimer, the term of this patent is extended or adjusted under 35 U.S.C. 154(b) by 0 days.

(21) Appl. No.: 09/496,165

(22) Filed: Feb. 1, 2000

(51) Int. Cl.[7] ..... B08B 9/053
(52) U.S. Cl. ..... 134/167 C; 15/104.061
(58) Field of Search ..... 134/167 C, 168 C; 15/104.061, 104.12; 166/312

(56) References Cited

U.S. PATENT DOCUMENTS 3,052,302 A * 9/1962 Lagucki ..... 15/104.061 X
3,251,416 A * 5/1966 Kiel ..... 166/312
4,744,420 A * 5/1988 Patterson et al. ..... 166/312
4,899,821 A * 2/1990 Casida ..... 166/312
5,086,842 A * 2/1992 Cholet ..... 134/167
5,402,850 A * 4/1995 Lalande et al. ..... 166/312

* cited by examiner

*Primary Examiner*—Philip R. Coe

(57) ABSTRACT

A collapsible pig attached to the end of a tubing and having a seal to the bore of a pipeline for pulling the tubing into the pipeline at up to a predetermined pressure differential across the seal and while allowing the fluid in front of the pig to flow into the end of the tubing without pressure restriction, alternately having reversed flow from within the tubing exit the end of the tubing through jetting nozzles, and having the seal collapse at a pressure differential higher than the predetermined pressure differential.

22 Claims, 4 Drawing Sheets

COLLAPSIBLE PIG

BACKGROUND OF THE INVENTION

The field of this invention of that of tools used for the cleaning of pipelines, especially the long extended reach pipelines in offshore areas. As hot production crude is produced from the reservoirs below the ocean floor up to the wellhead equipment at the ocean floor and then thru pipelines along the ocean floor, it is cooled by the relatively cool temperature of the ocean water. In deepwater, the temperature can be as cold as 35 degrees Fahrenheit.

A characteristic common to a majority of the oil produced is that there is a paraffin component to the oil which will deposit on the walls of the pipeline and become a solid at temperatures well above the 35 degrees Fahrenheit. In fact, some of the paraffins become a solid at temperatures above 100 degrees Fahrenheit, and so can be deposited or plated on the internal diameters of the pipelines at any expected ambient temperature. The process is similar to discussions of blocking of the arteries of a human being, with a thicker coating building up with time. Some pipelines have become so plugged that more than 90% of the flow area is blocked with the waxes or paraffins.

Typically, as the wall becomes layered with paraffin as the temperature of the oil goes below the solidification temperature of the particular paraffins in the produced fluids. The paraffins act as a sort of insulation to the flow in the pipeline, allowing it to maintain a higher temperature for a greater distance. The effect of this is to extend the distance along the pipeline it which the paraffin is plating onto the internal diameter of the pipeline.

A common cure for this paraffin plating out on the internal diameter of the pipeline is to insert a pig into the flow stream and let the pig remove some of the paraffin. A pig is typically a cylindrical or spherical tool which will brush against the internal diameter of the pipeline in hopes of removing the deposited paraffins. In pipelines with a high incidence of deposited paraffins, a regular maintenance of pigs is normally prescribed as a preventative to pipeline blockage.

One problem with the pigs is that the deposited paraffins are relatively soft and contain a lot of oil. To some extend, the pigs actually compress the paraffins against the wall and squeeze the oil out, leaving a harder and stronger paraffin remaining.

A second problem is that when the paraffin layer on the internal diameter of the pipe is too thick, sloughing off may occur. If the paraffin starts to separate from the wall and continues, it will tend to plow a block of paraffin ahead of itself. This will continue driving more and more paraffin off the wall of the pipeline until the pressure of the pipeline will no longer be able to move the mass. At that time you have a full pipeline blockage, which cannot be moved by pressure from either end.

At that time the plug of paraffin must be removed by direct intervention of chemicals or mechanical components. There can be no circulation of chemicals or other means through the pipeline to effect cleaning.

SUMMARY OF THE INVENTION

The object of this invention is to provide a pig which will seal on the internal bore of the pipeline and can be used with pumping to pull a small string of tubing to the site of the pipeline blockage in the pipeline and thereby establish a circulation path to the blockage inside and outside the tubing.

A second object of this invention is to allow the pig means which seal on the internal bore of the pipeline to be disengaged from the wall to allow recovery of the pig without having to swab all the fluids out of the pipeline as the pig is removed.

A third object of the invention is to allow the tubing string to jet fluid thru nozzles at the end of the tubing string, but to minimize pressure differentials across the orifices in reversed flow.

Another object of the invention is to prevent a cup type seal from being pulled backwards out of a pipeline and scraping a wax layer off the wall and causing a blockage.

BRIEF DESCRIPTION OF THE DRAWINGS

FIG. no. 1 is a half section thru a pig of this invention positioned within a pipeline.

FIG. no. 2 is a half section thru a pig of this invention in the mode of running into a pipeline toward a wax blockage.

Figure 1:
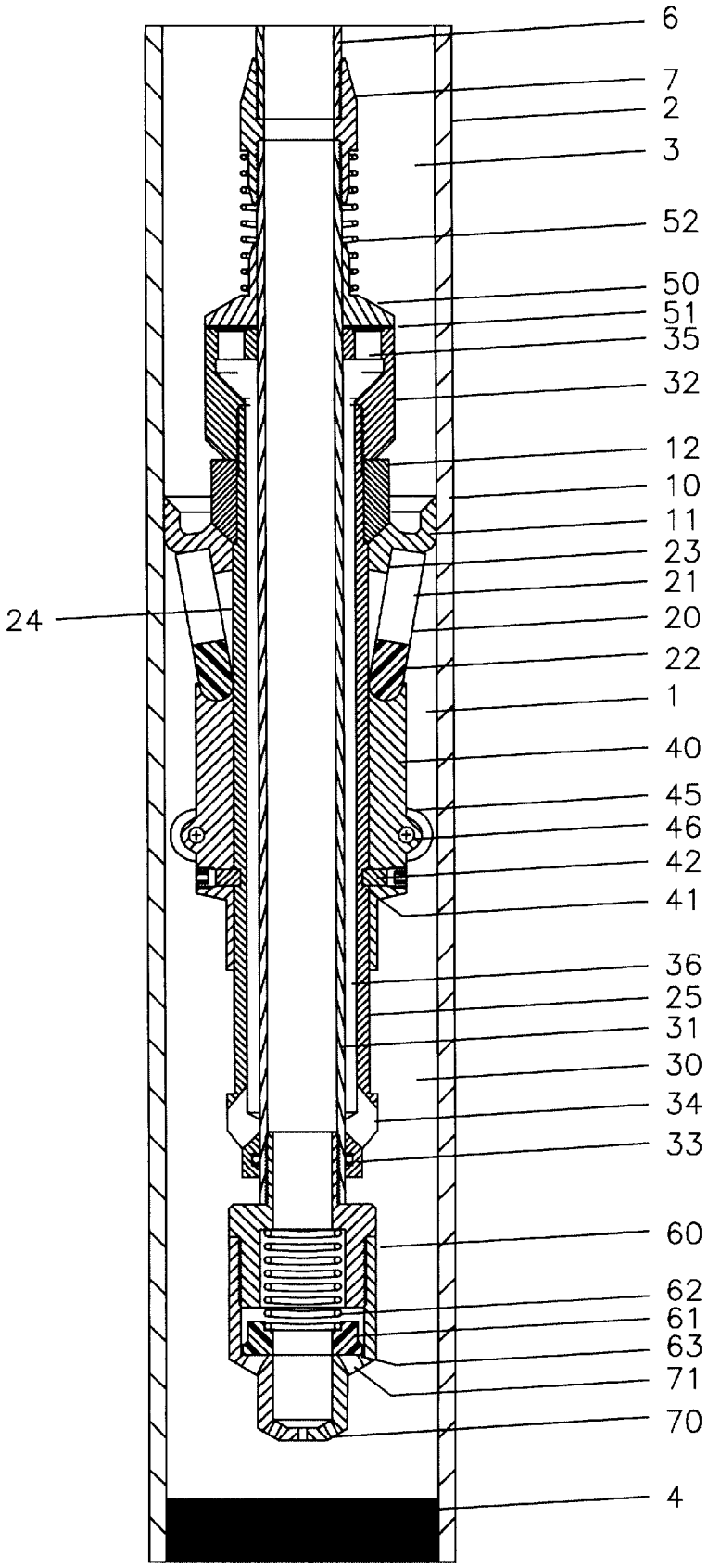

FIG. no. 3 is a half section thru a pig of this invention showing the flowpath while jetting toward a wax blockage.

FIG. no. 4 is a half section thru a pig of this invention with the sealing cup collapsed and being recovered from the pipeline.

DESCRIPTION OF THE PREFERRED EMBODIMENT

Referring now to FIG. no. 1, the pig 1 is in a pipeline 2 with an internal diameter 3 and a blockage 4. A tubing string 6 is shown attached to the top sub 7 of the pig. The tubing is typically of a coiled variety delivered to the job site on a reel.

The pig 1 is comprised of a sealing cup 10 having a flexible sealing cup 11 and a metal portion 12 for attachment. Armature 20 is a series of fingers 21 held together by bonded rubber type material 22. As shown, the rubber type material 22 is in tension, such that when the fingers 21 are removed from the diameter 23 they will move toward the diameter 24 of outer sleeve 25.

The central portion 30 of the pig 1 is comprised of an outer sleeve 25 and an inner sleeve 31 connected together thru a check valve body 32 and guided at 33. Porting 34 and 35 in conjunction with passageway 36 between outer sleeve 25 and inner sleeve 31 forms a circulation passage from one end of the pig to the other end.

Armature 20 is supported against loadings from the flexible sealing cup 11 by shear ring 40 and shear pins 41 engaging in groove 42. Shear ring 40 also supports wheels 45 on axles 46 to lower the sliding friction as the pig moves along the pipeline.

The central portion 30 connects to the top sub 7 and thereby interconnects to the tubing string 6.

Rear check valve 50 is shown lightly loaded against seat 51 by a spring 52. Upper check valve 50 will be opened when flow comes thru passageway 36 from the opposite end of the pig to allow circulation in one direction.

Front check valve 60 has a check ring 61 loaded by spring 62 onto seat 63. When pressure comes from the tubing string 6, the front check valve 60 is closed, requiring that the flow exit thru the restricted orifices 70. The accelerated flow velocities through the restricted orifices 70 causes a jetting action at the front of the pig 1 to assist in clearing blockages 4. In order to get the higher flow velocities, a pressure differential is required across the orifices 70, which are not a problem in the direction as described. They are a problem in the opposite direction as the higher pressure is imposed on the entire surface area of the pig, rather than simply the bore of the tubing.

When the flow is reversed, the check ring 61 of the front check valve 60 is lifted off the seat 63, and easy flow is accomplished thru large slots 71.

Figure 2:
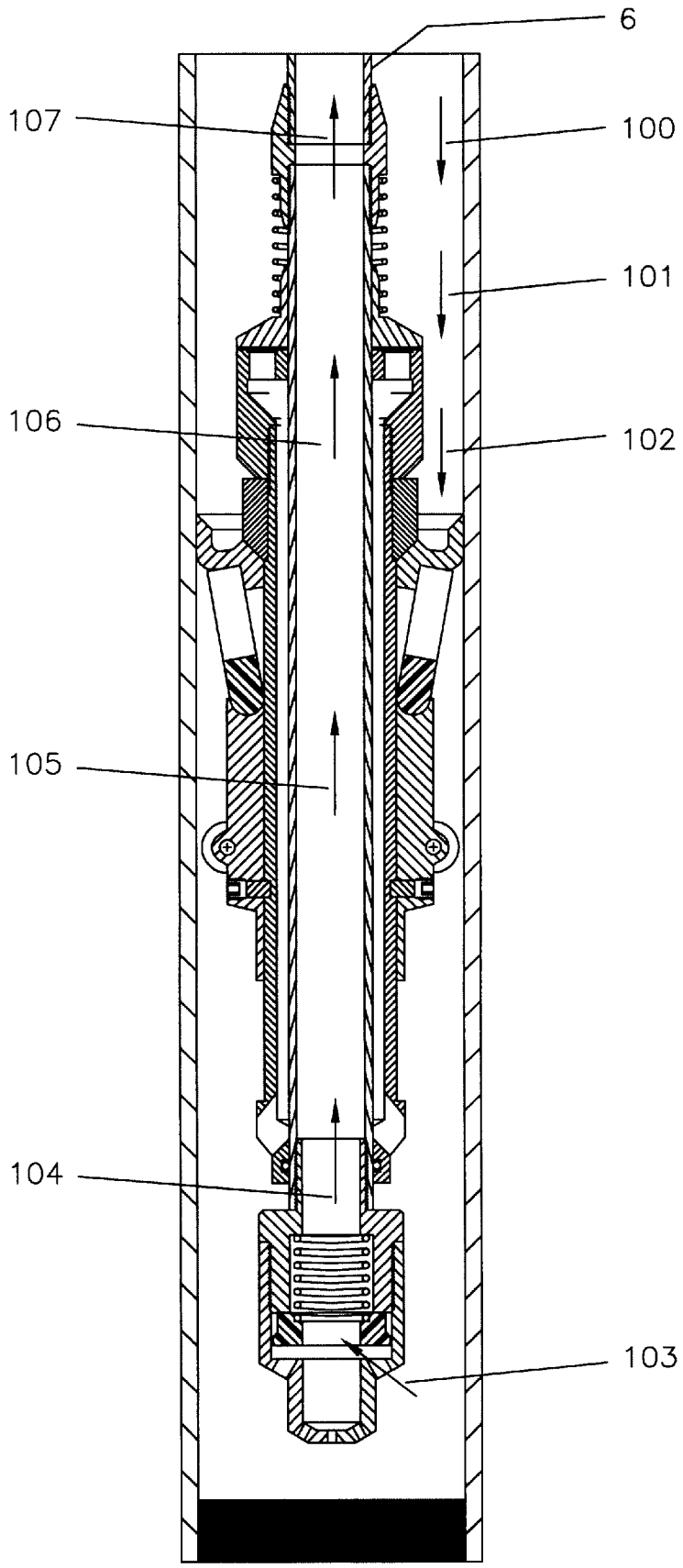

Referring now to FIG. 2, the collapsible pig is shown as it would be while moving into the pipeline. Arrows 100, 101, and 102 indicate the annular flow of fluids pushing against the cup type seal to provide a force on the pig and pulling the tubing 6. Arrow 103 indicates that fluid between the pig and the blockage 4 flowing into the tubing string, and arrows 104, 105, 106, and 107 show the flow along the bore of the tubing string.

Figure 3:
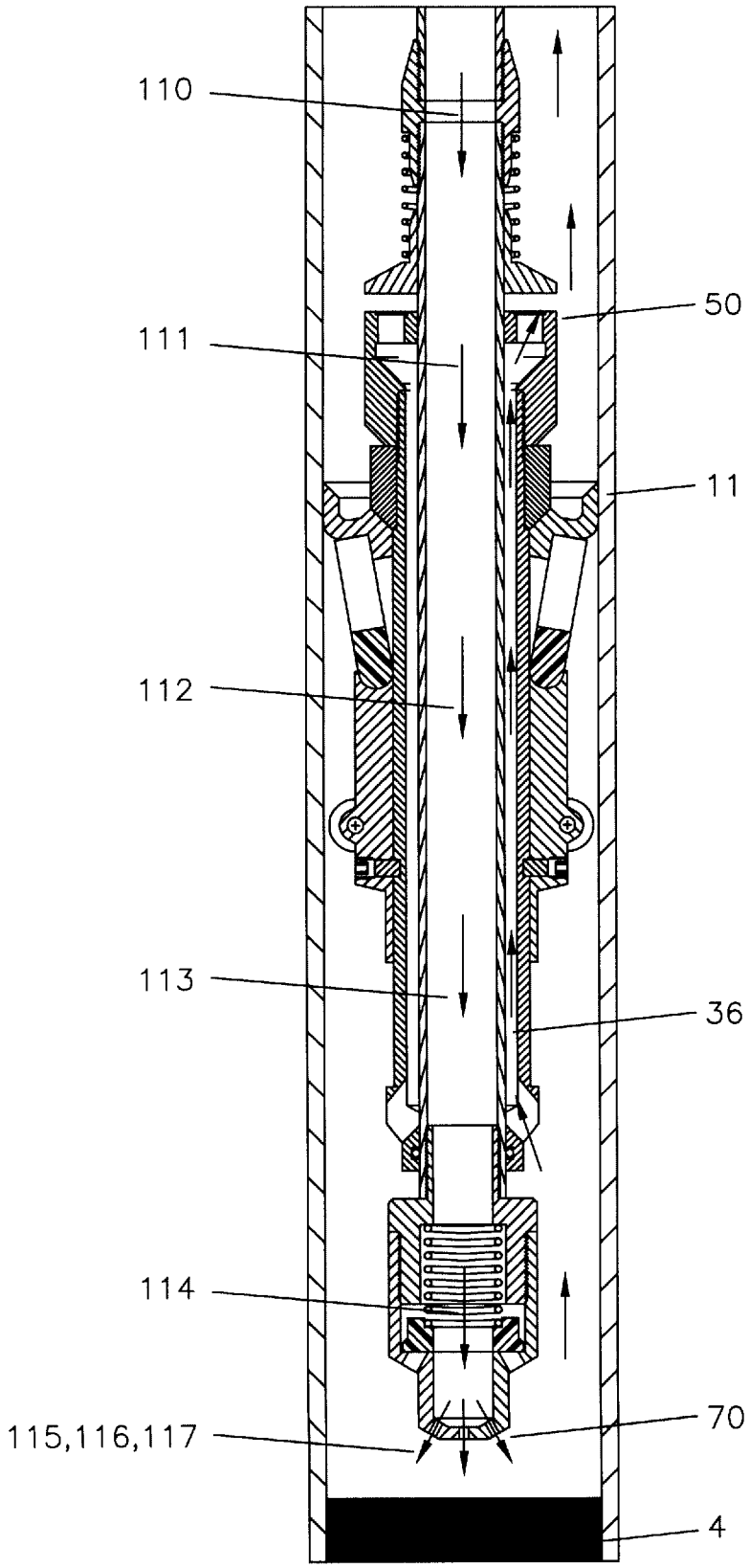
Figure 4:
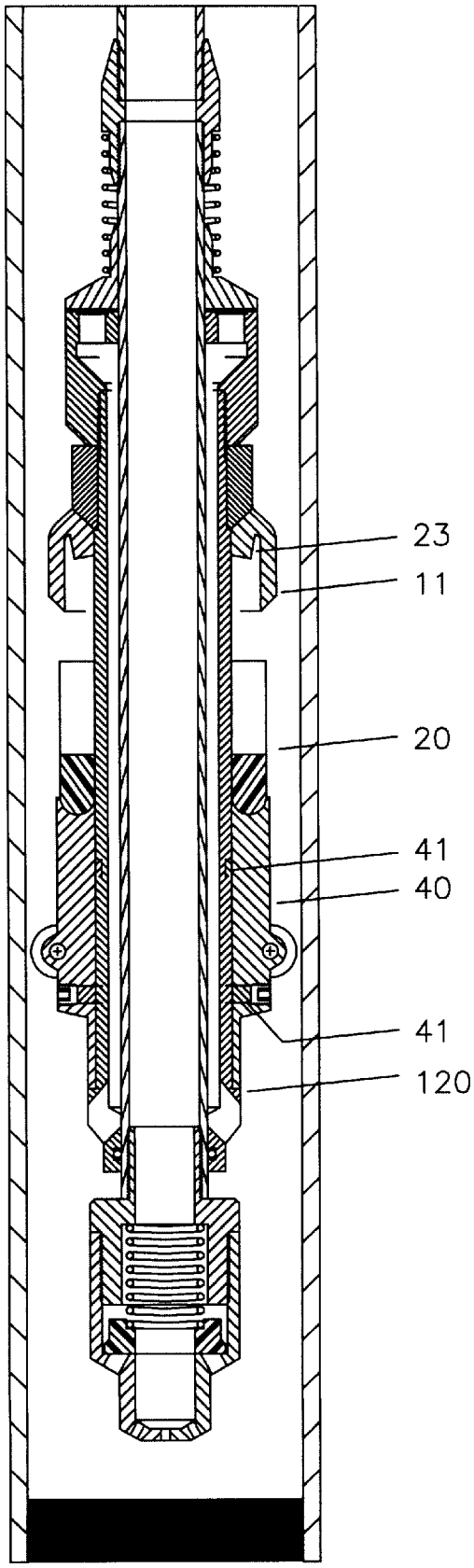

Referring now to FIG. 3, the flow in the interior of the tubing string 6 is shown as reversed with arrows 110 to 114 showing the flow in the tubing string. Arrows 115, 116, and 117 show the flow exiting thru orifices 70 and jetting toward the blockage 4 to help eliminate the blockage 4. The flow returns through passageway 36 and out rear check valve 50. If the flow could not bypass the flexible sealing cup 11 at a low pressure, the pressure would act against the cross sectional area of the seal and move the pig backwards and away from the blockage 4. It is essential that the jet nozzles stay near the blockage 4 in order to be effective in cleaning the blockage.

Referring now to FIG. no. 4, the pressure has been reversed again, and the pressure has been increased until a force was generated which sheared the shear pins 41 allowing the shear ring 40 to move down against the shoulder 120. As this happens, the armature 20 loses its support on diameter 23 allowing its resilient material to collapse the armature. As the armature 20 moves away from he flexible sealing cup 11, the cup loses its support allowing pressure to collapse. As the pig is then pulled out of the pipeline, the tendency to scrap residual wax off the pipeline wall is eliminated.

The foregoing disclosure and description of this invention are illustrative and explanatory thereof, and various changes in the size, shape, and materials as well as the details of the illustrated construction may be made without departing from the spirit of the invention.

What is claimed is:

1. A retrievable pig for pulling a tubing into a pipeline for pipeline maintenance or remediation operations, said tubing and said pipeline having an entrant end where said tubing enters said pipeline, said tubing having a distal end at a distance into said pipeline from said entrant end, and said pipeline extending beyond said distal end of said tubing; said tubing and said pipeline having a first internal area within said tubing, a first annular area outside said tubing and within said pipeline, and a second internal area beyond the distal end of said tubing, said retrievable pig comprising a seal member sealingly engaging between the outer surface of said tubing and the inner surface of said pipeline up to a predetermined pressure differential between said first annular area and said second internal area and not sealing at a differential pressure higher than said predetermined pressure differential, wherein said not sealing is caused by the release of a release mechanism.

2. The invention of claim 1, further comprising said release mechanism comprising one or more shear pins mounted in a shear ring which at approximately at said predetermined pressure differential said one or more shear pins are sheared.

3. The invention of claim 2, further comprising an armature of metal pieces mounted between said seal and said shear ring.

4. The invention of claim 3, further comprising said armature of metal pieces being at a first larger diameter adjacent said seal before said shear pins are sheared and being at a second smaller diameter at said shear pins are sheared.

5. The invention of claim 4, further comprising said metal pieces of said armature being interconnected by resilient material.

6. The invention of claim 1, wherein said seal member is a cup shaped seal with the cup portion facing toward said first annular area and away from said second internal area.

7. The invention of claim 6, wherein said cup shaped seal member becomes inverted when one or more shear pins are sheared by the force of said differential pressure across said cup.

8. The invention of claim 7, further comprising a first valve to allow flow from said second internal bore past said seal member to said first annular area but not from said first annular area past said seal member to said second internal bore, and a second valve to allow flow from said second internal bore to said first internal bore.

9. The invention of claim 8, further comprising one or more orifices to allow restricted flow from said first internal bore to said second internal bore to cause a jetting action near the distal end of said tubing when fluid is pumped from said first internal bore to said second internal bore.

10. A retrievable pig for pulling a tubing into a pipeline for pipeline maintenance or remediation operations, said tubing and said pipeline having an entrant end where said tubing enters said pipeline, said tubing having a distal end at a distance into said pipeline from said entrant end, and said pipeline extending beyond said distal end of said tubing; said tubing and said pipeline having a first internal area within said tubing, a first annular area outside said tubing and within said pipeline, and a second internal area beyond the distal end of said tubing, said retrievable pig comprising a seal member attached to said tubing and sealingly engaging the bore of said pipeline, a first valve to allow flow from said second internal bore past said seal member to said first annular area but not from said first annular area past said seal member to said second internal bore, and a second valve to allow flow from said second internal bore to said first internal bore.

11. The invention of claim 10, further comprising one or more orifices to allow restricted flow from said first internal bore to said second internal bore to cause a jetting action near the distal end of said tubing when fluid is pumped from said first internal bore to said second internal bore.

12. The invention of claim 11, further comprising that flow in said first annular area from said entrant end toward said distal end will move said retrievable pig and the distal end of said tubing farther from the entrant end of said pipeline and the fluid within the second internal area can pass from said second internal bore to said first internal bore without being restricted by said orifices.

13. The invention of claim 12, further comprising said seal member sealingly engaging between the outer surface of said tubing and the inner surface of said pipeline up to a predetermined pressure differential between said first annular area and said second internal area and not sealing at a differential pressure higher than said predetermined pressure differential.

14. The invention of claim 13, wherein said not sealing is caused by the release of a release mechanism.

15. The invention of claim 14, further comprising said release mechanism comprising one or more shear pins mounted in a shear ring which at approximately at said predetermined pressure differential said one or more shear pins are sheared.

16. The invention of claim 15, further comprising an armature of metal pieces mounted between said seal and said shear ring.

17. The invention of claim 16, further comprising said armature of metal pieces being at a first larger diameter adjacent said seal before said shear pins are sheared and being at a second smaller diameter after said shear pins are sheared.

18. The invention of claim 17, further comprising said metal pieces of said armature being interconnected by resilient material.

19. The invention of claim 18, wherein said seal member is a cup shaped seal with the cup portion facing toward said first annular area and away from said second internal area.

20. The invention of claim 19, wherein said cup shaped seal member becomes inverted when one or more shear pins are sheared by the force of said differential pressure across said cup.

21. A retrievable pig for pulling a tubing into a pipeline for pipeline maintenance or remediation operations, said tubing and said pipeline having an entrant end where said tubing enters said pipeline, said tubing having a distal end at a distance into said pipeline from said entrant end, and said pipeline extending beyond said distal end of said tubing; said tubing and said pipeline having a first internal area within said tubing, a first annular area outside said tubing and within said pipeline, and a second internal area beyond the distal end of said tubing, said retrievable pig comprising a cup seal attached to said tubing and sealing in the bore of the pipeline against a pressure differential from said first annular area to said second internal area, segmented support for said cup seal which is in turn positioned by a release mechanism, such that when said release mechanism is released said cup seal will become lose the ability to seal in said pipeline against said pressure differential from said first annular area to said second internal area.

22. The invention of claim 22, wherein said release mechanism comprises one or more shear pins and a collapsible armature.

* * * * *